US006343871B1

(12) United States Patent
Yu

(10) Patent No.: US 6,343,871 B1
(45) Date of Patent: Feb. 5, 2002

(54) BODY HEIGHT ADJUSTABLE ELECTRIC BULB FOR ILLUMINATED SIGNS

(76) Inventor: William Yu, 12310 Herrington Manor Dr., Silver Spring, MD (US) 20904

( * ) Notice: Subject to any disclaimer, the term of this patent is extended or adjusted under 35 U.S.C. 154(b) by 0 days.

(21) Appl. No.: 09/532,305

(22) Filed: Mar. 22, 2000

(30) Foreign Application Priority Data

Nov. 8, 1999 (CN) ..... 99240217.4

(51) Int. Cl.[7] ..... F21V 21/00

(52) U.S. Cl. ..... 362/250; 362/800; 362/812; 362/252

(58) Field of Search ..... 362/252, 800, 362/249, 812, 250, 287, 427, 418, 227; 40/544, 550, 570

(56) References Cited

U.S. PATENT DOCUMENTS 5,463,280 A 10/1995 Johnson
5,506,760 A 4/1996 Giebler et al.
5,526,236 A 6/1996 Burnes et al.
5,575,459 A 11/1996 Anderson
5,655,830 A 8/1997 Ruskouski
5,688,042 A 11/1997 Madadi et al.
5,726,535 A 3/1998 Yan
5,729,925 A 3/1998 Prothero
5,806,965 A * 9/1998 Deese ..... 362/800
5,921,660 A 7/1999 Yu
5,947,588 A * 9/1999 Huang ..... 362/800
D415,582 S 10/1999 Camarota
6,036,336 A * 3/2000 Wu ..... 362/250

* cited by examiner

*Primary Examiner*—Thomas M. Sember
(74) *Attorney, Agent, or Firm*—Dowell & Dowell, P.C

(57) ABSTRACT

A body height adjustable electric bulb for illuminated sign wherein the bulb comprises a height adjusting unit inserted into an open end of a bulb body against friction between them such that the height of the bulb body can be adjusted by a force against such friction. A connector is fixed on a bulb head and connects to a joint end of the height adjusting unit such that the bulb body can be rotated by a proper torque.

10 Claims, 2 Drawing Sheets

BODY HEIGHT ADJUSTABLE ELECTRIC BULB FOR ILLUMINATED SIGNS

BACKGROUND OF THE INVENTION

1. Field of the Invention

The invention relates to an electric bulb for an illuminated sign and, in particular, to a height adjustable bulb for an illuminated sign.

2. Description of Related Art

Generally, an identification lamp or illuminated sign comprises a bulb and a flat lantern case or housing for accommodating the bulb to show noticeable identifications created by opening(s) in panels of the housing with emitting and shadowing patterns at both sides.

The lamp or bulb known today is conventionally an incandescent bulb. With such a point-source bulb, the light from ID lamp is not homogeneous, and a troublesome beam spot is observable. Furthermore, the bulb suffers from high power consumption and short life.

A solution for these problems has been disclosed in China Patent No. 97204601.1, titled "Electric Bulb for Identification Lamp", filed on Jan. 2, 1997 by the applicant and authorized by Chinese Patent Office on Jul. 30, 1998. In such solution, however, the novel bulbs include light emitting diodes (LEDs). Such bulbs must be made in different sizes to substitute for different sizes of incandescent bulbs, since the height of each novel bulb is fixed. Thus, The lamp bulb described in China Patent No. 97204601.1 lacks in the ability of being interchangeable, and there is a need for a better solution.

SUMMARY OF THE INVENTION

Therefore, The primary object of the invention is to provide a body height adjustable bulb for an illuminated sign emitting homogeneous light with low power consumption and long life-time.

Another object of the invention is to provide an illuminated sign comprising such an electric bulb.

To attain these objects, a body height adjustable lamp bulb according to the invention is comprised of a bulb body, a bulb head, a connector, a plurality of light emitting diodes (LEDs) positioned around the periphery of the bulb body, and a power supply unit for the LEDs.

The lamp bulb further comprises a height adjusting unit inserted into an open end of the bulb body having proper friction between them such that the height of the bulb body can be adjusted by a force directed against the friction, the connector is fixed on the bulb head at one end, and the another end connects to a joint end of the height adjusting unit such that the bulb body can be rotated by a proper torque.

The components of the power supply unit are set within the bulb body or the height adjustable unit.

With the configuration described above, in a body height adjustable ID lamp bulb according to the invention, the well-distributed light can be obtained by rotation of the bulb and thus changing the direction of emitted light, and the height of bulb body can be adjusted by the movement of the body height adjusting unit to substitute for incandescent bulbs of different sizes. In addition to these advantages, the power consumption is lower, and the life expectancy is longer. The adjustable features are not only useful for the lamp bulb but also applicable to any lamps requiring adjustment of light emitting direction.

BRIEF DESCRIPTION OF DRAWINGS

The features, objects, and advantages of the invention will become more apparent from the detailed description set forth below when taken into conjunction with the drawings, wherein.

DETAILED DESCRIPTION OF PREFERRED EMBODIMENT

The body height adjustable lamp bulb of the present invention is an improvement of the bulb described in the Chinese Patent No. 97204601.1 authorized to the same applicant described above, so the contents disclosed in the Patent, and which are also disclosed in corresponding U.S. Pat. No. 5,921,660, are incorporated by reference herein.

Figure 1:
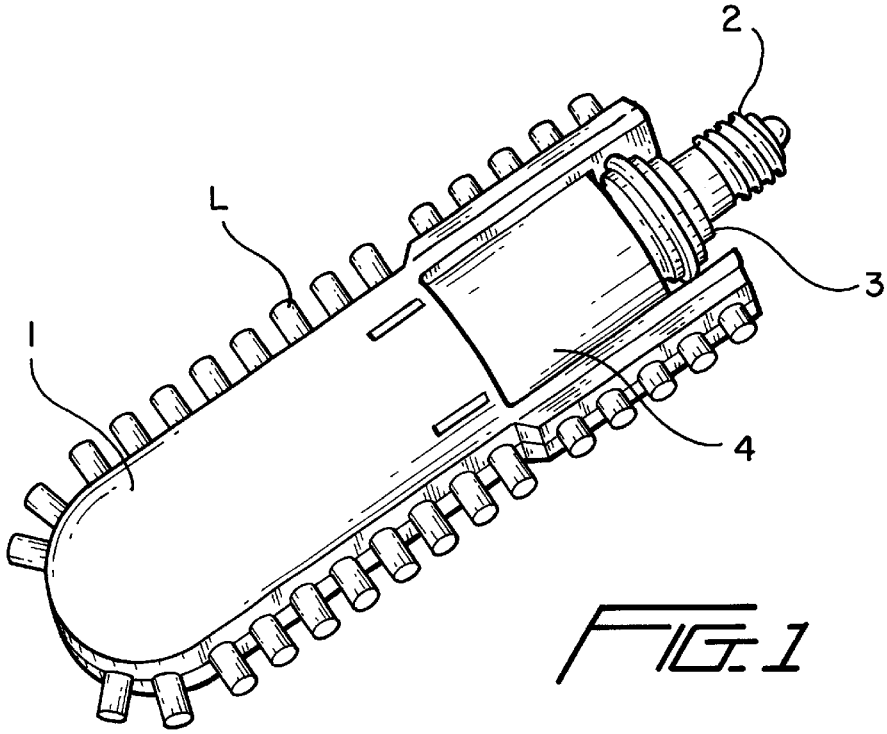
FIG. 1 is an overall drawing of an embodiment of lamp bulb according to the invention.
Figure 3:
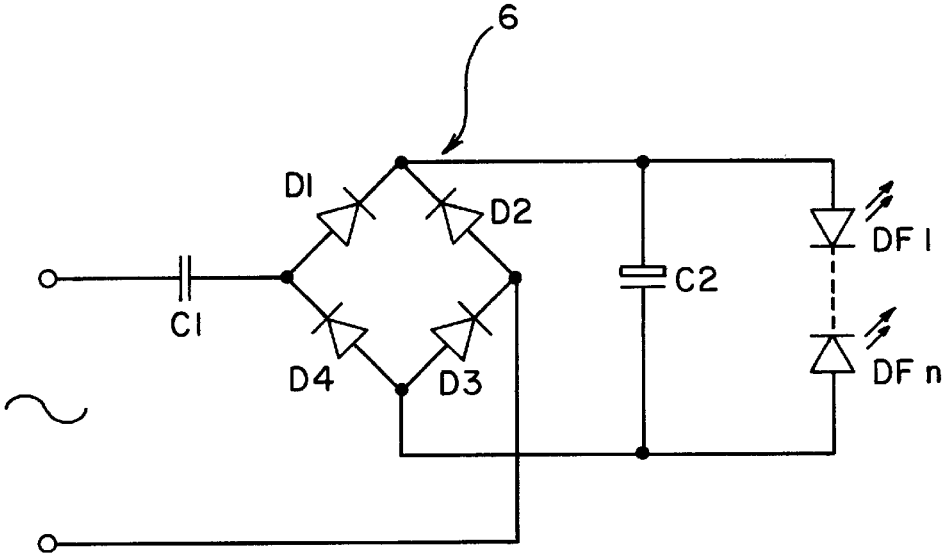
FIG. 3 is a power supply circuit diagram for the embodiment of FIG. 1.
Figure 2:
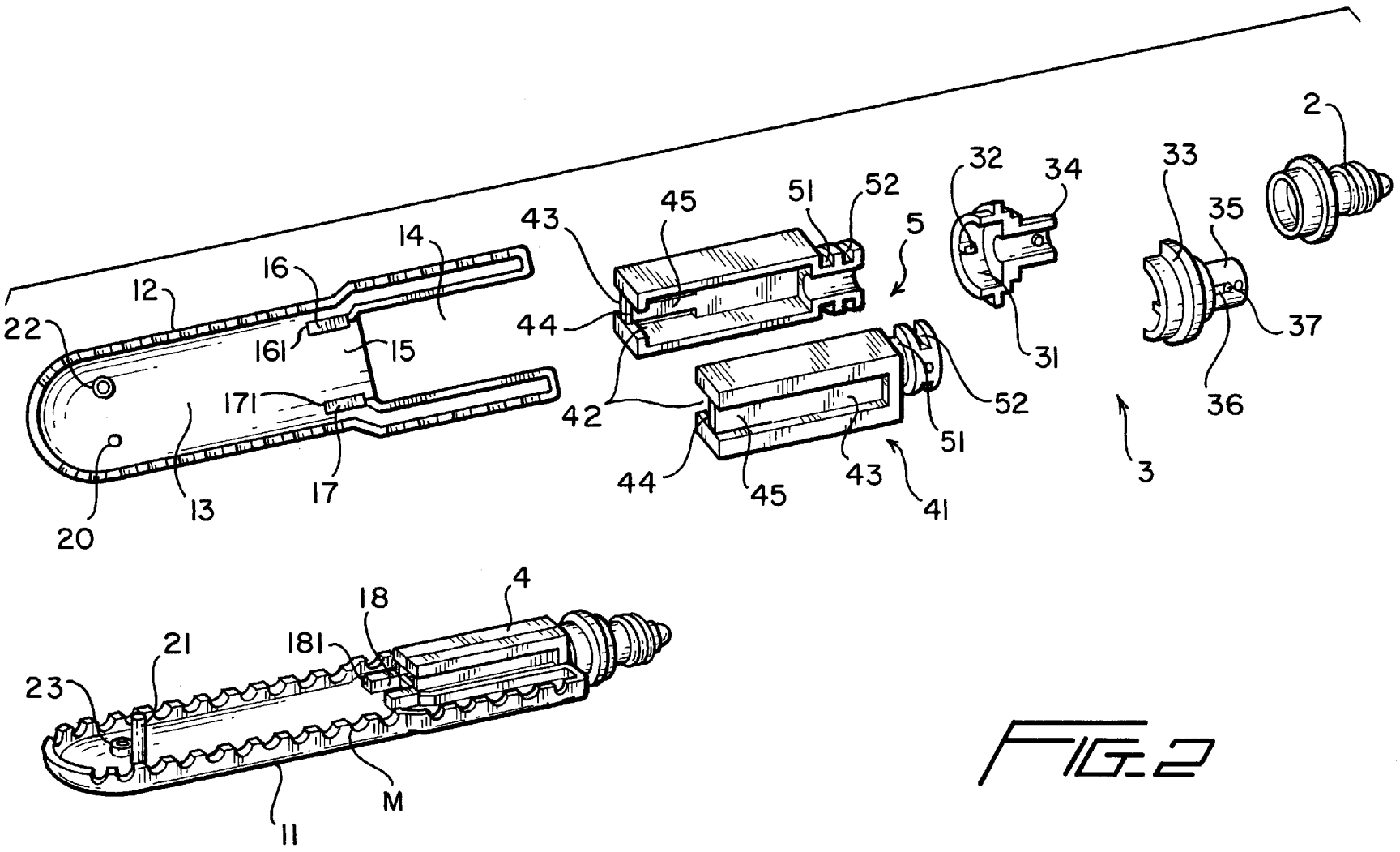
FIG. 2 is an exploded view of the lamp bulb shown in FIG. 1.

Now, referring to FIG. 1 and FIG. 2, the body height adjustable lamp bulb of the invention comprises a bulb body 1, a bulb head 2, a connector 3, a plurality of LEDs "L" positioned around the periphery of the bulb body 1, and a power supply unit to power the LEDs "L" (referring to FIG. 3 in Chinese Patent No. 97204601.1).

The bulb further comprises a height adjusting unit 4 inserted into an open end of the bulb body 1 with proper friction between them such that the height of the bulb body can be adjusted by a force against the proper friction. The connector 3 is fixed on the bulb head 2 at one end, and another end connects to a joint end 5 of the height adjusting unit 4 such that the bulb body can be rotated by a proper torque.

The components of power supply unit (not shown) are suitably set within the bulb body 1 or height adjustable unit 4.

The invention is directed to the height adjustable unit 4 set between connector 3 and bulb body 1. As for the connector 3, the implementation and changes of structure and the connection with bulb head 2 and joint end 5 of height adjusting unit 4 (corresponding to the connection end 11 of bulb body 1 in Chinese patent No. 97204601.1) thereof were described in detail therein. However, the typical structure of connector 4 will be discussed briefly in the following description.

Referring to FIG. 2, the main part 41 of height adjusting unit 4 is hollow and substantially rectangular. At one shorter side of the main part 41, there is a cylindrical joint end 5 with an outer face ring slot 51 having a least one lug (not shown). One end of the connector 3 is fixed on the bulb head 2. Inside the cavity at the other end of connector 3, there is a concave ring 31 having at least one boss 32. When the height adjusting unit 4 is connected to the connector 3 by its joint end 5, the concave ring 31 in connector 3 joins with the ring slot 51 on joint end 5 of height adjusting unit 4 such that the height adjusting unit 4 can be rotated with respect to the connector 3 by a proper torque. The lug in slot 51 and the boss 32 on convex ring 31 function as a stop to limit rotation when the bulb is screwed on a socket with its bulb head 2. At the other shorter side of main part 41, there is a hole 42 to get through internally from the main part 41 to the bulb body 1. Along the edges of both longer sides of the main part 41, guide slots 43 are provided respectively for height adjusting, and reeds 45 with a small hook 44 are formed in the guide slots 43 at its one end toward the hole 42. Furthermore, the height adjusting unit 4 consists of two parts 41 obtained by dividing a cuboid equally along its longitudinal axis from the vertical direction of its wider planes (i.e. the upper and lower planes in FIG. 2).

The connector 3 is combined by two substantially similar multi-step approximately half-cylindrical hollow pieces (i.e. front connector 33 and back connector 34) which couple together face to face. At a particular end of the combined connector 3, there is a wiring slot 36 on the outer step surface 35 of front connector 33 and/or back connector 34e and a wiring hole 37 cut through to the cavity of connector 3 is located at a suitable point on the wiring slot 36. When the connector 3 is fixed on the bulb head 2 with its particular end, one of the power leads from bulb body 1 or main part 41 will be wired into the wiring slot 36 through the wiring hole 37 via the cavity, and fastened by a metal wrapping of bulb head 2 for electrical conduction, while another power lead will be soldered with the contact on bulb head 2.

The bulb body 1 is combined by two similarly configured long and flat cases 11,12 coupling together to form a cavity 13 for containing power supply components and height adjusting unit 4 to perform body height adjustment. In one side of the bulb body 1, there is a rectangular opening area 14 for suitably accessing of the main part 41 of height adjusting unit 4. Moreover, at the bottom of opening area 14, there is an insertion gate or entrance 15 for the height adjusting unit 4 with guide bars 16,17,18 and 19 located on the cases 11, 12, respectively to fix the two cases 11 and 12 at their one side by adapting to the guide slots 43 on height adjusting unit 4 and perform height adjusting against the friction between them. In addition, the bottom ends 161,171 and 181 of guide bars 16,17 and 18 can join with the small hooks 44 of reeds 45 respectively, to prevent the height adjusting unit 4 from sliding out of the bulb body 1 during height adjusting. A guide bar and its bottom end opposing guide bar 18 are not shown in FIG. 2 for clear illustration. Furthermore, in another side of the bulb body 1, a solid post 20, 21 and a hollow post 22, 23 extend from the inner sides of cases 11, 12, respectively, to join and fix the two cases 11, 12 by the insertion of solid posts into hollow posts.

There are a plurality of small holes "M" around the perihery of bulb body 1 to arrange a plurality of light emitting diodes (LEDs) "L" such that they are distributed evenly general around the periphery of the joint section between the two cases 11 and 12 on the bulb body 1 with their optical axes located substantially within the coupling plane of two cases 11 and 12.

Moreover, there are two parallel slots 52, (one is not shown in FIG. 2 since it is located in the opposite side) around the cylindrical joint end 5 to fix the height adjusting unit 4 at a determined position.

In the assembling process, firstly, the two cases 11, 12 are coupled together by fixing the upper and lower pieces of bulb body 1 at their one side with a mutual insertion of the solid posts 20, 21 and the hollow posts 22, 23. Then, after the coupling of the left-half and right-half of height adjusting unit 4, the height adjusting unit 4 is inserted in the insertion gate 15 in bulb body 1 by a pushing force to overcome the friction caused by the relative movement of the guide slots 43 on both sides of the main part 41 and the guide bars 16 in both sides of the insertion gate 15. The other side of bulb body 1 is fixed due to the vertical locking of guide slot 43, while the left piece and right piece of height adjusting unit 4 are fixed due to the horizontal locking of the cases 11 and 12. The friction described above is set such that the height of bulb body 1, after an adjustment, should not be affected by external vibration.

It should be understood that the structure of height adjusting unit 4 given in FIG. 2 is simply an exemplary preferred embodiment according to the invention. This is not the only structure, and various changes can be made. For example, when an integrated structure of bulb body 1 is adopted, one side of bulb body 1 may be opened, and then sealed with a cover after the installation of power supply unit in it. In this structure, the height adjusting unit 4 may also be integrated into a whole piece.

Accordingly, the mutual locking of bulb body 1 and height adjusting unit 4 is not required, and therefore, there is no need for the two guide slots 43 and guide bars 16, 17 and 18. Instead there is need of a structure such as a convex ring around the inner edge of insertion gate 15 and a number of reeds having a hook, respectively, on the other side of main part 41 of height adjusting unit 4. The friction required may occur between the convex ring and the surface of main part 41. The principle of the invention is the height adjustment of the bulb body 1 with an additional height adjusting unit 4 for the substitution of incandescent bulbs of different standard sizes by one bulb according to the invention of an ID lamp. Therefore, the particular structure of height adjusting unit 4 should not be taken as the limit of the invention.

Next, referring to FIG. 3, is a circuit diagram of the power supply unit 6 according to the invention. As shown in FIG. 3, in the power supply unit 6, a bridge rectifier circuit consists of the diodes, D1, D2, D3 and D4 with a serial current-limitting capacitor C1 in its input and a parallel filter circuit in its output to feed a plurarity of light emitting diodes L (DF 1, DF2 . . . DFn) serially. It has the advantages of fewer components and simple circuit configuration.

Thus, the details of the invention have been described in conjunction with the embodiment.

The bulb according to the invention is capable of lighting any existing illuminated sign to replace an incandescent bulb.

To fit the bulb in a sign, one may screw or insert the screw type or bayonet-capped type bulb head into a socket in the sign case, and pull the bulb body and adjust its height to that of corresponding incandescent bulb, then, turn the bulb body counter-clockwise by hand until the flat surfaces of the bulb body are parallel with the front and back panels of the sign case. In such condition, the light does not cast directly to the viewers' eyes, since the optical axis of each LED is not directed to the front and back panels of the case or housing.

Furthermore, although one end of the bulb body is open, the LEDs are distributed on both sides of the opening of the bulb body, and the height adjusting unit performs height adjustment therein, thereby these LEDs are lighted all around the bulb, and the lamp is emitting a well-distributed light around its light source. Moreover, in contrast to the incandescent bulb emitting a point-source light, the LEDs are arranged well around the bulb body; thus a homogeneous diffuse light illuminates from the front and back panels of an ID lamp without any beam spot, showing a noticeable identification with soft light to viewers from both sides.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

I claim:

1. A body height adjustable electric bulb for an illuminated signs lamp comprising; a bulb body, a bulb head, a connector, a plurality of light emitting diodes set around at least a portion of periphery of said bulb body, and a power supply unit to power said light emitting diodes, a height adjusting unit inserted into an open end of said bulb body so as to create a frictional sliding engagement between said height adjusting unit and said bulb body such that the height of said bulb body can be adjusted relative to said bulb head by a force applied against the friction, said connector being fixed on said bulb head at one end and another end connected to a joint end of said height adjusting unit such that said bulb body can be rotated by an applied torque, and said power supply unit being mounted within at least one of said bulb body and said height adjusting unit.

2. The body height adjustable electric bulb of claim 1, wherein said height adjusting unit is hollow and including a substantially rectangular main part having a cylindrical joint end with an outer ring slot therein having at least one lug; one end of said connector being fixed on said bulb head, and at another end, inside a cavity of said connector, there is a concave ring having at least one boss whereby when said height adjusting unit is connected to said connector at said joint end, said concave ring of said connector seats with said ring slot such that said height adjusting unit can be rotated with respect to said connector by application of a torque, and said lug in said ring slot and said boss on said concave ring acting to stop rotation when the bulb is screwed on a socket with said bulb head.

3. The body height adjustable electric bulbs of claim 2 wherein said height adjusting unit includes guide slots extending; along opposite sides of said main part, and said bulb body including portions slideably received in said guide slots, and hook means in said guide slots adjacent one end of said height adjusting unit oriented towards said bulb body.

4. The body height adjustable electric bulb of claim 3, wherein, said height adjusting unit consists of two parts dividing equally along a longitudinal axis.

5. The body height adjustable electric bulb of claim 4, including an opening in said one end of said height adjusting unit.

6. The body height adjustable electric bulb of claim 2 wherein said connector includes two substantially similar approximate half-cylindrical pieces which are joined together, wherein at one end of said connector there is a wiring slot communicating said with a hole to a cavity of said connector, whereby, when said connector is fixed on said bulb head, a first electrical power lead from said bulb body and extending through said main part will extend into said wiring slot through said hole and said cavity to a metal piece of said bulb head, while another electric power lead is secured to an electrical contact on said bulb head.

7. The body height adjustable electric bulb of in claim 1, wherein said bulb body is formed by two similarly configured long and flat cases coupling together to form a cavity for containing components of said power supply unit and said height adjusting unit, in one end of said bulb body there is an opening for receiving a main part of said height adjusting unit, guide bars located on said two cases to thereby slideably engage said two cases within guide slots on said height adjusting unit to thereby permit height adjustment against the friction created therebetween, and ends of said guides bars can abut small hooks within said slots to prevent said height adjusting unit from sliding out of said bulb body during height adjusting.

8. The body height adjustable bulb of claim 7 wherein said bulb body includes, a solid post and a hollow post extending from inner sides of said two cases, respectively, to join and fix said two cases by insertion of said solid post into said hollow post, and a plurality of small holes around a periphery of said bulb body to receive said plurality of light emitting diodes.

9. The body height adjustable electric bulb of claim 8, wherein said plurality of light emitting diodes are distributed evenly general around the periphery of said two cases of said bulb body with their optical axes located substantially within a coupling plane of said two cases.

10. The body height adjustable electric bulb of claim 1, wherein in said power supply unit includes a bridge rectifier circuit consisting of diodes D1, D2, D3 and D4 in series, a limiting capacitor C1 in an input and a parallel filter capacitor in an output to power said plurality of light emitting diodes serially.

* * * * *